US007123689B1

(12) United States Patent
Wilson

(10) Patent No.: US 7,123,689 B1
(45) Date of Patent: Oct. 17, 2006

(54) FIELD EMITTER X-RAY SOURCE AND SYSTEM AND METHOD THEREOF

(75) Inventor: Colin Richard Wilson, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 11 days.

(21) Appl. No.: 11/172,749

(22) Filed: Jun. 30, 2005

(51) Int. Cl.
*H01J 35/32* (2006.01)
*H01J 35/08* (2006.01)
*H01J 35/06* (2006.01)

(52) U.S. Cl. ..... 378/122; 378/123; 378/136

(58) Field of Classification Search ..... 378/119, 378/122, 124, 136, 137, 123, 138; 313/309, 313/310, 336, 351; 445/50, 51
See application file for complete search history.

(56) References Cited

U.S. PATENT DOCUMENTS 5,961,362 A * 10/1999 Chalamala et al. ..... 445/59
6,385,292 B1 5/2002 Dunham et al. ..... 378/122
6,553,096 B1 * 4/2003 Zhou et al. ..... 378/122
6,670,629 B1 12/2003 Wilson ..... 257/10
6,750,470 B1 6/2004 Wilson ..... 257/10
6,899,584 B1 5/2005 Wilson ..... 445/50
6,912,268 B1 * 6/2005 Price et al. ..... 378/122

OTHER PUBLICATIONS

M. Hajra et al. "Effect of gases on the field emission properties of ultrananocrystalline diamond-coated silicon field emitter arrays", Journal Of Applied Physics. vol. 94, No. 6. Sep. 15, 2003, pp. 4079-4083.

* cited by examiner

*Primary Examiner*—Edward J. Glick
*Assistant Examiner*—Irakli Kiknadze
(74) *Attorney, Agent, or Firm*—Fletcher Yoder

(57) ABSTRACT

In accordance with one embodiment, the present technique provides an X-ray source. The X-ray source includes a field emitter array having a plurality of field emitter elements disposed in a vacuum chamber and configured to emit electrons in the vacuum chamber towards an anode assembly. The X-ray source also includes an anode disposed in the vacuum chamber for receiving the electrons emitted by the field emitter array and configured to thereby generate X-ray radiation. The X-ray source further includes a source of cleaning gas coupled to the vacuum chamber, wherein the source of cleaning gas is configured to provide the cleaning gas to the vacuum chamber towards the field emitter array to reduce deposition of contaminants on or to clean contaminates from the field emitter array.

20 Claims, 5 Drawing Sheets

FIELD EMITTER X-RAY SOURCE AND SYSTEM AND METHOD THEREOF

BACKGROUND

The present invention relates generally to generating X-rays, and specifically to an improved method and system for generating X-rays using a field emitter X-ray source.

X-ray systems are generally utilized in various applications, such as for imaging in the medical and non-medical fields. For example, X-ray systems, such as radiographic systems, computed tomography (CT) systems, and tomosynthesis systems, are used to create images or views of tissues of a patient based on the attenuation of X-ray beams passing through the patient. X-ray systems and sources may also be utilized to in non-medical applications, such as detecting minute flaws in equipment or structures, and scanning baggage, crystallography, to mention only a few.

Typically, a X-ray system includes an X-ray source that generates X-ray beams that are directed towards a detector or film. Conventional X-ray tubes generate a beam of X-rays by bombarding a rotating anode with a stream of electrons in vacuum tube. More recent developments have provided a design in which an electron source, such as an array of field emitters, and an anode assembly, are housed inside an evacuated tube. The field emitters include sharp tips that are subjected to high electric currents to emit electrons by a phenomenon called field emission. The electrons thus emitted, travel across an open space at very high speeds and collide with the anode assembly to produce the X-ray beams.

In field emitter X-ray sources, the tips of the field emitters can become degraded by deposition of oxides and other contaminations. A low level of contamination in field emitters may be tolerated in applications such as flat panel displays. However, these contaminations can significantly affect the performance of the field emitters that are subjected to very high electric currents in applications such as X-ray systems.

Thus, there exists a need for an improved field emitter X-ray source for generating X-rays. There is a particular need in the art for techniques that will limit or correct the deposition of contaminates in field emitter arrays, thereby permitting the arrays to be more effective over a longer useful life.

BRIEF DESCRIPTION

Briefly, in accordance with one embodiment, the present technique provides an X-ray source. The X-ray source includes a field emitter array having a plurality of field emitter elements disposed in a vacuum chamber and configured to emit electrons in the vacuum chamber towards an anode assembly. The X-ray source also includes an anode disposed in the vacuum chamber for receiving the electrons emitted by the field emitter array, and configured to thereby generate X-ray radiation. The X-ray source further includes a source of cleaning gas coupled to the vacuum chamber, wherein the source of cleaning gas is configured to provide cleaning gas to the vacuum chamber towards the field emitter array to reduce deposition of contaminants on or to clean contaminates from the field emitter array.

In accordance with another aspect of the present technique, a method of generating X-rays is provided. The method includes creating a vacuum in a vacuum chamber. The method also includes applying an electric current to a field emitter array disposed in the vacuum chamber to emit electrons. The method also includes receiving the emitted electrons on an anode to produce X-ray radiation that is emitted from the vacuum chamber, operation of the field emitter array and anode resulting in deposition of contaminants on the field emitter array. The method further includes introducing a cleaning gas into the vacuum chamber to contact the field emitter array to remove contaminants from the field emitter array.

DRAWINGS

These and other features, aspects, and advantages of the present invention will become better understood when the following detailed description is read with reference to the accompanying drawings in which like characters represent like parts throughout the drawings, wherein.

Figure 5:
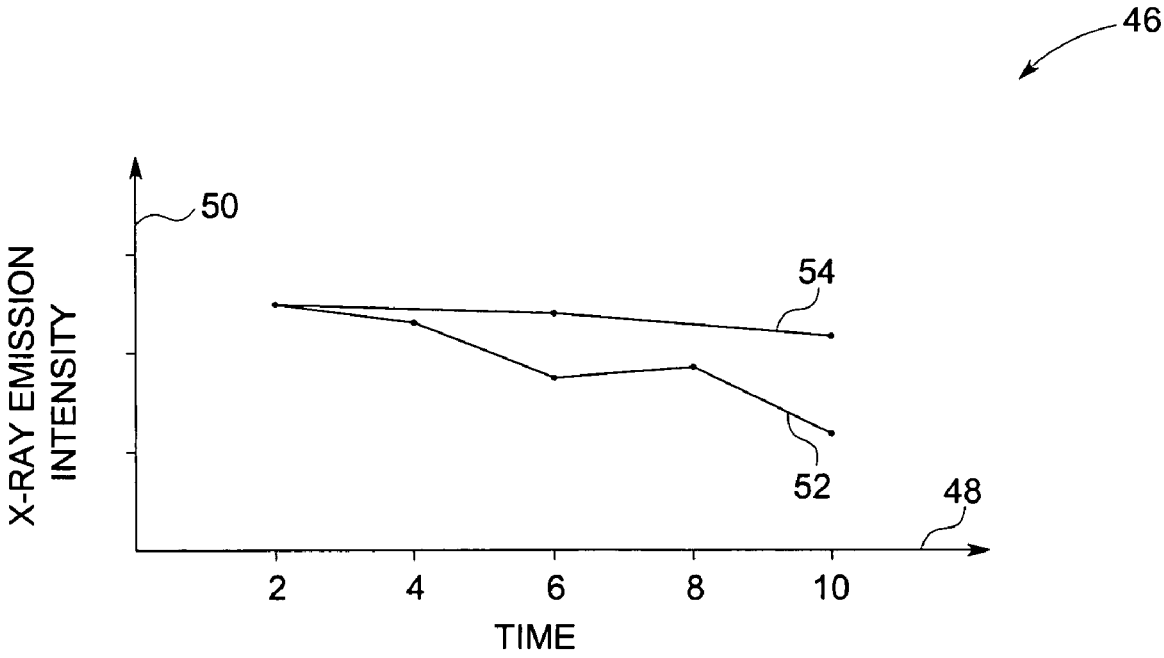
Figure 6:
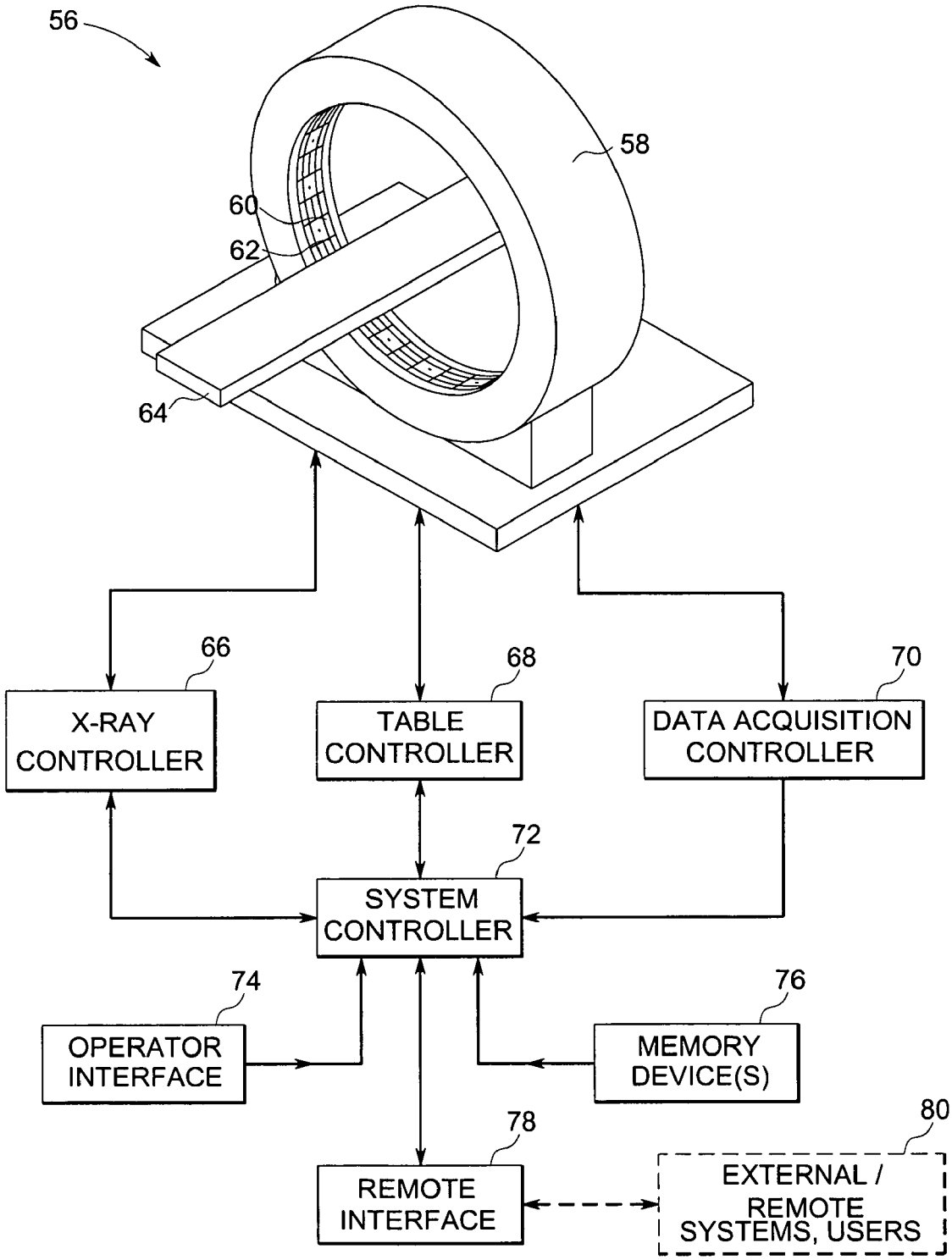
Figure 7:
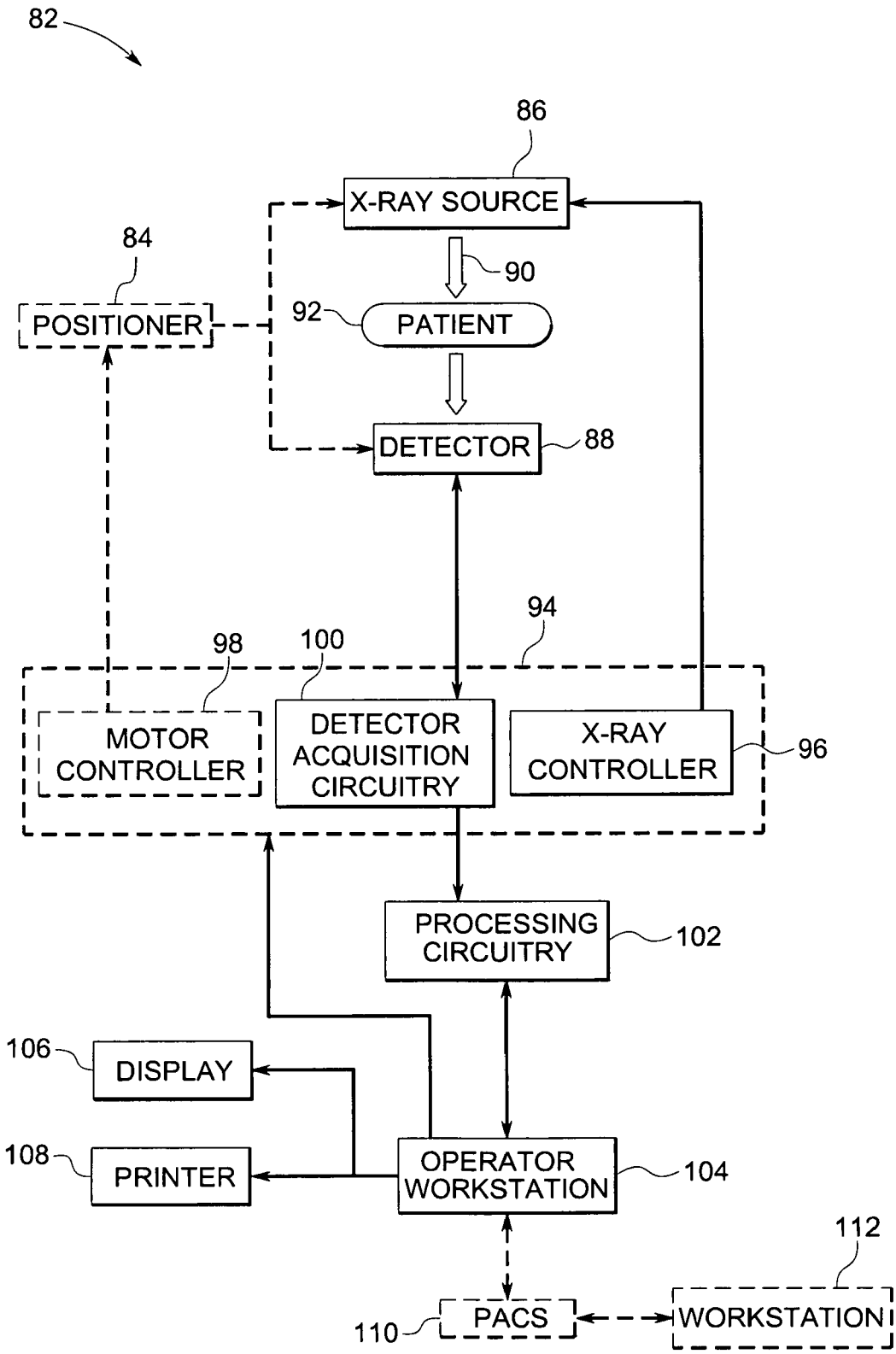

FIG. 5 graphically represents X-ray emission intensity of an X-ray source versus time to explain the anticipated benefit of periodic circulation of cleaning gas for the emitter array in accordance with aspects of present technique;

FIG. 6 is a diagrammatical representation of an exemplary application of the improved field emitter technique and X-ray source, in this case in a stationary CT system; and FIG. 7 is diagrammatical representation of a further exemplary application of the present techniques in a multi-energy tomosynthesis system.

DETAILED DESCRIPTION

The present technique is generally directed towards an X-ray source, which may be used for medical and non-medical applications, and likewise for imaging and non-imaging applications. Such applications may include, without limitation, patient evaluation, and passenger and/or baggage screening, and generally to provide useful two-dimensional and three-dimensional data and context. To facilitate explanation of the present techniques, however, medical implementations will be generally discussed herein, though it is to be understood that non-medical implementations are also within the scope of the present techniques.

Figure 1:
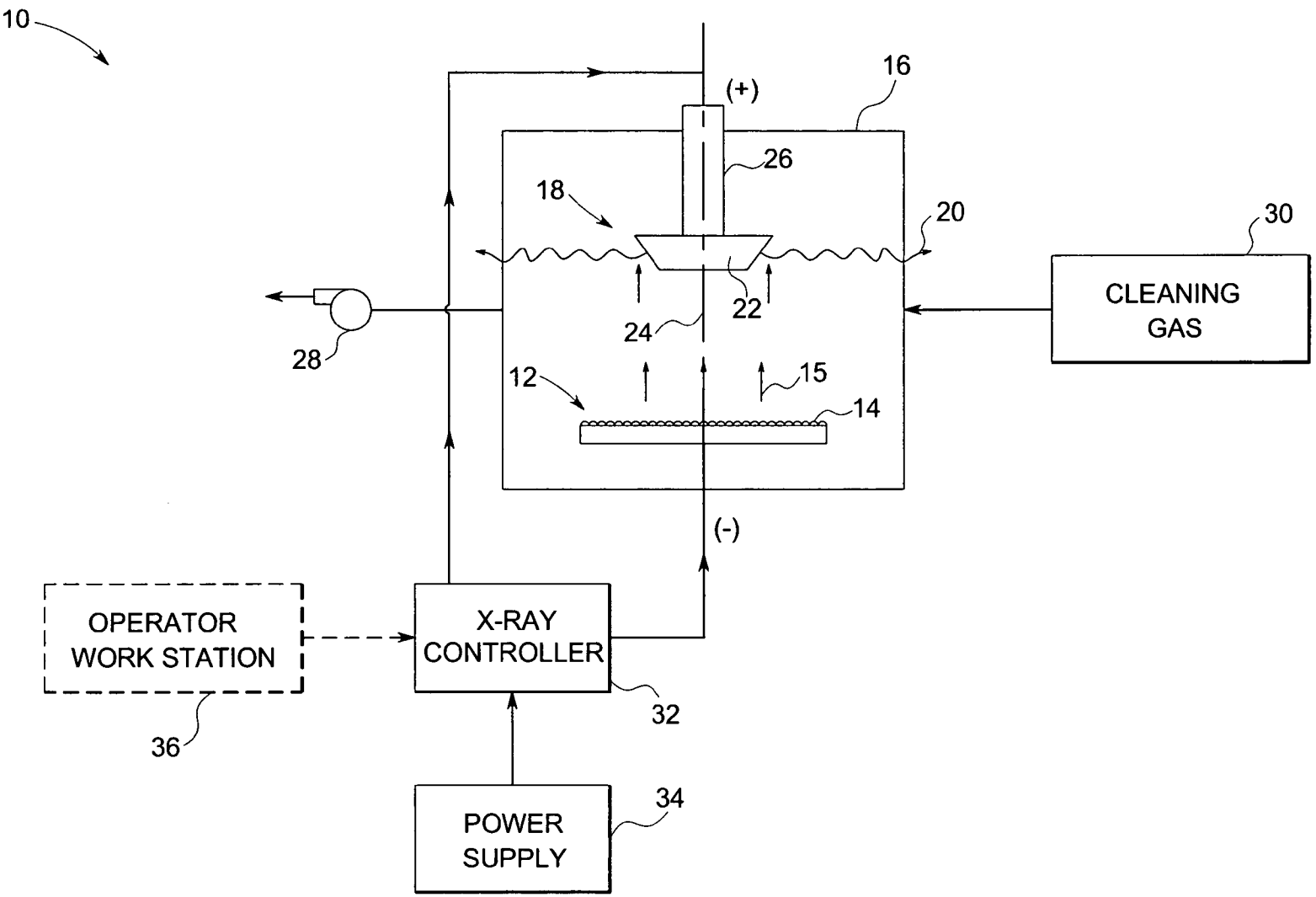
FIG. 1 is a diagrammatic representation of an improved field emitter X-ray source, in accordance with an exemplary embodiment of present technique.

Turning now to the drawings, and referring first to FIG. 1, an exemplary embodiment of an improved field emitter X-ray source system 10 for use in accordance with the present technique is illustrated diagrammatically. The field emitter X-ray source system 10 includes a field emitter array 12 having a number of field emitter elements 14. The X-ray source system 10 may also include more than one field emitter array 12. As described above, the field emitter elements 14 emit electrons 15 by a phenomenon called field emission (FE), when subjected to electric field. The field emitter array 12 acts as a negative electrode. The field emitter elements 14 are made of materials that have high endurance to electrical stress and have good thermal conductivity. Thus the field emitter elements 14 are typically made of carbides, oxides, nitrides, tungsten, copper, platinum, nickel, molybdenum or silicon. Structurally, the field emitter elements 14 may include micro tips, nano-tips, nano-wires, nano-tubes or nano-structure. In certain applications, to provide for independently located points in the X-ray source system 10 individual field emitter arrays 21 may be individually addressable (i.e., capable of being energized separately upon delivery of appropriate energizing signals. In imaging applications, therefore, each field emitter array can be individually controlled and activated in accordance with a desired imaging protocol. The field emitter array 12 is disposed inside a vacuum chamber 16.

The X-ray source system 10 also includes an anode 18, which is also disposed inside the vacuum chamber 16. The anode 18 acts as a positive electrode. The anode 18 emits X-rays 20 upon collision of electrons emitted by the field emitter elements 14. The anode 18 generally includes different components that are utilized to produce X-rays 20. For instance, the anode 18 may include an anode disk 22 that is configured to rotate about a longitudinal axis 24 of the X-ray source system 10. The anode disk 22 may be constructed from tungsten alloy or other suitable material. The rotation of the anode disk 22 facilitates improving thermal conditions of the anode disk 22, i.e. dissipating heat due to operations. The anode 18 also includes other components, such as a stem 26 for supporting the anode disk 22 and a rotor with bearings (not shown) to facilitate rotation of the anode disk 22. In certain embodiments, the X-ray source system 10 may include more than one anode 18 to generate X-rays 20.

The vacuum chamber 16 of the X-ray source system 10 may be made of glass or metallic material. The vacuum chamber 16 is coupled to a vacuum system to create a vacuum or partial pressure inside the vacuum chamber 16 on the order of about $10^{-4}$ to $10^{-9}$ Torr. In the present embodiment, the vacuum system includes a vacuum pump 28.

As described above, the tips of the field emitter elements 14 can become degraded by deposition of oxides and other contaminations, which adversely affect the performance of the X-ray source system 10. Hence, the X-ray source system 10 includes a cleaning gas source 30. The cleaning gas source 30 is coupled to the vacuum chamber 16. The cleaning gas source 30 provides a cleaning gas to the vacuum chamber that may be directed towards or generally into contact with the field emitter array 12 to reduce the deposition of contaminants on or to clean contaminates from the field emitter array 12. In certain embodiments, the cleaning gas source 30 provides the cleaning gas into the vacuum chamber 16 intermittently when there is no emission of electrons by the field emitter elements 14 of the field emitter array 12. In another embodiment, the cleaning gas source provides the cleaning gas to deposit active sites on the field emitter array, which in turn enhances the performance of the field emitter array. In the present embodiment, the X-ray source system uses hydrogen as the cleaning gas. In another embodiment, water vapor may be used as the cleaning gas. Alternatively, the cleaning gas may also include inert gases, such as nitrogen (N2), argon (Ar). Other gases may be suitable for removal of contaminants as well.

The X-ray source system 10 may be controlled by an X-ray controller 32. A power supply 34 provides electric current to the field emitter array 12 and the anode through the X-ray controller 32. An operator may control and operate the X-ray source system 10 through an operator workstation 36. The operator workstation 36 may include input devices such as a keyboard, a mouse, and other user interaction devices (not shown).

Figure 2:
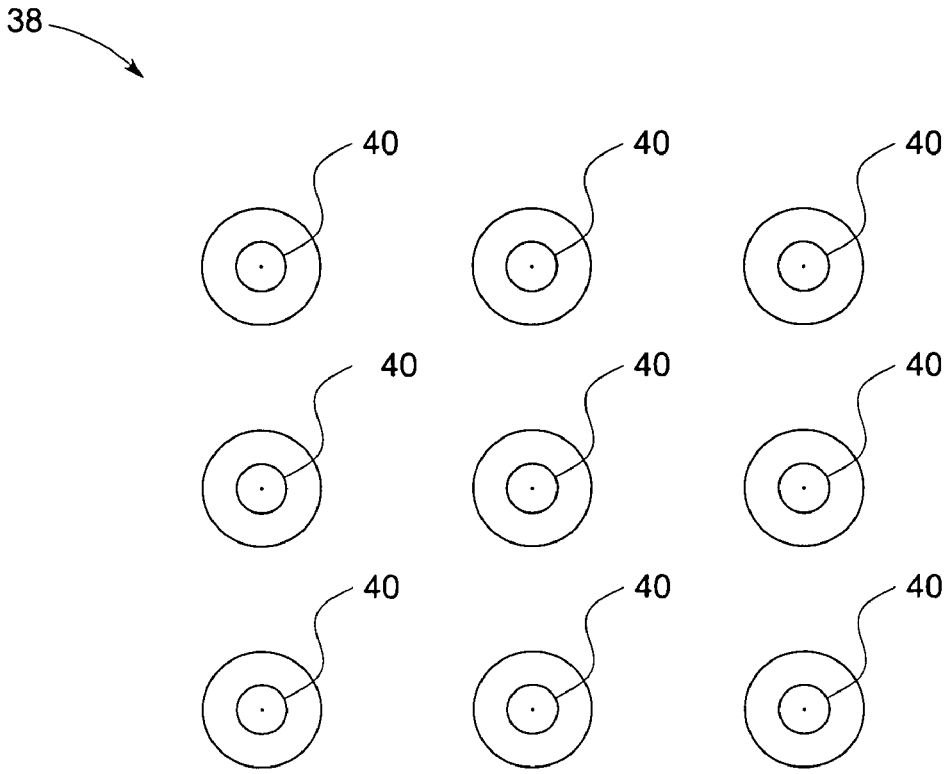
FIG. 2 is a top view of an exemplary field emitter array of the type suitable for use in the source of FIG. 1.

FIG. 2 is a top view of a field emitter array 38 having a number of field emitter elements 40 arranged in an array, in accordance with an exemplary embodiment of present technique. In general, a field emitter array may include many more field emitter elements that that is illustrated in FIG. 2.

Figure 3:
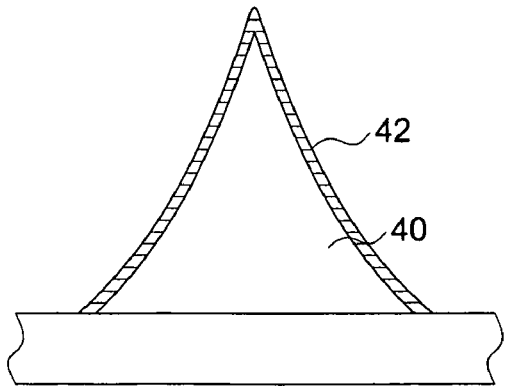
FIG. 3 is an enlarged front view of a field emitter element of the array of FIG. 2 subjected to contaminants that may be reduced or eliminated in accordance with aspects of present technique.

FIG. 3 is an enlarged front view of the field emitter element 40 subjected to contaminants that may be reduced or eliminated by the periodically introduced cleaning gas in accordance with aspects of present technique. As described above, during operation, the field emitter element 40 can become degraded by deposition of oxides and other contaminations 42, which adversely affect the performance of the X-ray source system.

Figure 4:
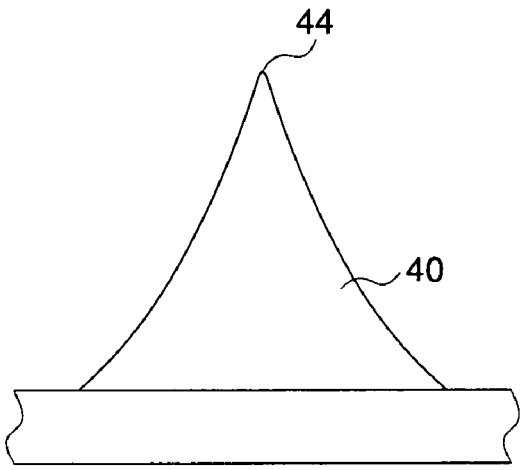
FIG. 4 is an enlarged front view of a field emitter element protected or maintained by cleaning gas, in accordance with aspects of present technique.

FIG. 4 is an enlarged front view of the field emitter element 40 protected or maintained by cleaning gas. FIG. 4 depicts the surface of the field emitter element 40, particularly the tip of the field emitter element 44 being protected from the deposition of oxides and other contaminations by the cleaning gas. The protection provided by the cleaning gas improves the electron emission characteristics of the field emitter element and hence improves the X-ray emission intensity. The cleaning gas may also to deposit active sites on the field emitter array which enhances the performance of the field emitter array.

Turning briefly to FIG. 5, a graph 46 is provided depicting X-ray emission intensity of an X-ray source versus time. The X-axis 48 represents the time, in hours. The Y-axis 50 represents X-ray emission intensity. Curve 52 represents the intensity of X-ray emission by an X-ray source having field emitter array. Curve 52 depicts typical deterioration of the performance of the field emitter array in terms of X-ray emission intensity with time due to the deposition of oxides and other contaminations over the field emitter elements of the field emitter array. On the other hand, curve 54 represents the anticipated intensity of X-ray emission by the X-ray source having field emitter array protected or cleaned by a cleaning gas. The curve 54 clearly depicts the improvement in the performance of the field emitter array when the field emitter elements of the field emitter array are protected by the cleaning gas.

In a typical application, the X-ray source would be utilized in its normal mode of operation to produce X-rays. During such operation, the chamber in which the emitter array or arrays are disposed will be evacuated as described above. Periodically, then, the cleaning gas is introduced to remove deposited contaminants. This may be done by simply releasing a supply of gas (e.g., by opening a valve), or by pumping the gas into the chamber for circulation over the emitter arrays. The cleaning operation effectively removes the contaminants from the emitters, and also evacuates them from the chamber. Following the cleaning operation, then, the cleaning gas source is once again isolated from the chamber (e.g., by closing the valve), and the chamber is once again evacuated for normal operation of the X-ray source. In presently contemplated embodiments, the cleaning operation may simply be performed periodically. However, the operation may also be planned based on the actual use of the source, or may be performed as a maintenance operation based upon sensed changes in emission intensity, or other sensed parameters.

FIG. 6 is a diagrammatical representation of an exemplary application of the improved field emitter technique and X-ray source, in a stationary computerized tomography (CT) system 56, in accordance with an exemplary embodiment of present technique. The CT system 56 comprises a scanner 58 formed of a support structure and internally containing one or more stationary and distributed sources of X-ray radiation and one or more stationary digital detectors, as described below. The X-ray source contains a number of independently addressable field emitter arrays represented by dots 60, placed around a ring detector 62. The X-ray source also includes an anode (not shown), which generates X-rays upon collision of the electrons emitted by the field emitter array with the anode. The field emitter array and the anode are disposed inside a vacuum chamber. As described above, in order to protect the field emitter elements of the field emitter array against the deposition of oxides and other contaminations, the X-ray source includes a cleaning gas source (not shown) to provide hydrogen gas into the vacuum chamber to the X-ray source. The scanner 58 is further configured to receive a table 64 or other support for a patient, or, more generally, a subject to be scanned.

The system further includes an X-ray controller 66, a table controller 68 and a data acquisition controller 70, which may all function under the direction of a system controller 72. The X-ray controller 72 regulates timing for discharges of X-ray radiation, which is directed from points around the scanner 58 toward a detector segment on an opposite side thereof. The detector 62 is provided with apertures through which the source can emit radiation. The arrangement permits for additional data to be collected between the locations where the distributed source emits through the detector. Data acquisition controller 70, coupled to detector elements receives signals from the detector elements and processes the signals for storage and later image reconstruction.

The various circuitry described herein, may be defined by hardware circuitry, firmware or software. The particular protocols for imaging sequences, for example, will generally be defined by code executed by the system controllers. Moreover, initial processing, conditioning, filtering, and other operations required on the transmitted X-ray intensity data acquired by the scanner may be performed in one or more of the components depicted in FIG. 1.

System controller 72 is also coupled to an operator interface 74 and to one or more memory devices 76. The operator interface 74 may be integral with the system controller 72, and will generally include an operator workstation for initiating imaging sequences, controlling such sequences, and manipulating data acquired during imaging sequences. The memory devices 76 may be local to the CT imaging system 56, or may be partially or completely remote from the system. Moreover, the memory devices 76 may be configured to receive raw, partially processed or fully processed data for reconstruction.

FIG. 7 is diagrammatical representation of a further exemplary application of the present techniques in a tomosynthesis system 82, in accordance with an exemplary embodiment of present technique. As depicted, the tomosynthesis system 82 includes a positioner or a support 84 that supports an X-ray source 86. The X-ray source 86 may employ different techniques for X-ray generation and emission. In the present embodiment, the X-ray source 86 utilizes field emitter arrays to generate electrons, which upon collision with an anode generate X-rays. The X-ray source XX further includes an anode (not shown). The field emitter array and the anode are disposed inside a vacuum chamber. The X-ray source 86 also includes a cleaning gas source (not shown). As described above, the cleaning gas source provides hydrogen gas to the X-ray source 86 to protect against the deposition of oxides and other contaminations over the field emitter elements of the field emitter array and thus, improves the X-ray emission intensity of the X-ray source 86.

The positioner 84 also supports an X-ray detector 88. The X-ray detector 88 may be an analog detector or a digital detector. The X-ray source 86 emits the X-rays 90 through a patient 92 towards the X-ray detector 88. The X-ray detector 88 receives this X-rays 90 and is configured to generate signals in response to the X-rays. The X-ray detector 88 may be stationary or may move in coordination with or independent from the X-ray source 86 and/or support 84.

The operation of the X-ray source 86 may be controlled by a system controller 94. The motion of the X-ray source 86 and/or the X-ray detector 88 may also be controlled by the system controller 94, such as by the motor controller 98, to move independently of one another or to move in synchrony. The system controller 94 may employ positioner 84 to facilitate the acquisition of radiographic projections at various angles through the patient.

The system controller 94 may also control the operation and readout of the X-ray detector 88, such as through detector acquisition circuitry 100. Processing circuitry 102 is typically present to process and reconstruct the data read out from the X-ray detector 88 by the detector acquisition circuitry 100. In particular, projection data or projection images are typically generated by the detector acquisition circuitry 100 in response to the X-rays emitted by the X-ray source 86.

Processing circuitry 102 may also include memory circuitry to store the processed and to be processed data. The memory circuitry may also store processing parameters, and/or computer programs.

The processing circuitry 102 may be connected to an operator workstation 104. The images generated by the processing circuitry 102 may be sent to the operator workstation 104 for display, such as on the display 106. The processing circuitry 102 may be configured to receive commands or processing parameters related to the processing or images or image data from the operator workstation 104, which may include input devices such as a keyboard, a mouse, and other user interaction devices (not shown). The operator workstation 104 may also be connected to the system controller 94 to allow an operator to provide commands and scanning parameters related to the operation of the X-ray source 86 and/or the X-ray detector 88 to the system controller 94. Hence an operator may control the operation of all or part of the tomosynthesis system 82 via the operator workstation 104.

The operator workstation 104 may be coupled to a picture archiving and communication systems (PACS) 110. The PACS 110 may be utilized to archive the captured X-ray images. Accordingly, the operator workstation 104 may access images or data accessible via the PACS 110 for processing by the processing circuitry 102, for displaying on the display 106, or for printing on the printer 108. Also, the PACS 110 may be coupled to a remote workstation 112 to provide remote access to the X-ray images.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An X-ray source comprising:

a field emitter array having a plurality of field emitter elements disposed in a vacuum chamber and configured to emit electrons in the vacuum chamber towards an anode assembly;

an anode disposed in the vacuum chamber for receiving the electrons emitted by the field emitter array and configured to thereby generate X-ray radiation;

a source of cleaning gas coupled to the vacuum chamber, wherein the source of cleaning gas is configured to provide the cleaning gas to the vacuum chamber towards the field emitter array to reduce deposition of contaminants on or to clean contaminates from the field emitter array; and a vacuum pump configured to create a vacuum inside the vacuum chamber following introduction of the cleaning gas to evacuate the vacuum chamber.

2. The X-ray source of claim 1, wherein the plurality of field emitter elements of the field emitter array comprises carbides, oxides, nitrides, tungsten, copper, platinum, nickel, molybdenum or silicon.

3. The X-ray source of claim 1, wherein the field emitter array includes a plurality of field emitter elements having micro tips, nano-tips, nano-wires, nano-tubes or nano-structures.

4. The X-ray source of claim 1, wherein the X-ray source comprises a plurality of individually addressable field emitter arrays, each array comprising a plurality of field emitter elements.

5. The X-ray source of claim 1, wherein the cleaning gas comprises hydrogen.

6. The X-ray source of claim 1, wherein the source of the cleaning gas is configured to provide the cleaning gas into the vacuum chamber intermittently to reduce deposition of contaminants on or clean contaminates from the field emitter array.

7. The X-ray source of claim 1, wherein the anode assembly comprises a plurality of anodes.

8. A method of generating X-rays, comprising:

creating a vacuum in a vacuum chamber;

applying an electric current to a field emitter array disposed in the vacuum chamber to emit electrons;

receiving the emitted electrons on an anode to produce X-ray radiation that is emitted from the vacuum chamber, operation of the field emitter array and anode resulting in deposition of contaminants on the field emitter array;

introducing a cleaning gas into the vacuum chamber to contact the field emitter array to remove the contaminants from the field emitter array; and evacuating the chamber to remove the cleaning gas from the chamber.

9. The method of claim 8, comprising introducing the cleaning gas when there is no emission of electrons by the field emitter array.

10. The method of claim 8, comprising creating a partial pressure of about $10^{-4}$ to $10^{-9}$ Torr inside the vacuum chamber.

11. A method of generating X-rays, comprising:

disposing a field emitter array having a plurality of field emitter in a vacuum chamber, wherein the field emitter array is configured to emit electrons;

disposing an anode in the vacuum chamber for receiving the electrons emitted by the field emitter array, wherein the anode is configured to generate X-rays;

coupling a vacuum system to the vacuum chamber, wherein the vacuum system is configured to create a vacuum inside the vacuum chamber; and coupling a clean gas source to the vacuum chamber, wherein the clean gas source provides cleaning gas to the vacuum chamber towards the field emitter array to reduce deposition of contaminants on or to clean contaminants from the field emitter array;

wherein the vacuum system is configured to evacuate the chamber after introduction of cleaning gas to remove the cleaning gas from the chamber after cleaning.

12. The method of claim 11, comprising coupling an X-ray controller to the field emitter array, wherein the field emitter array includes a plurality of independently controllable field emitter arrays, and the X-ray controller regulates production of X-rays from the field emitter arrays in accordance with a desired imagine protocol.

13. The method of claim 11, comprising creating a partial pressure of about $10^{-4}$ to $10^{-9}$ Torr inside the vacuum chamber.

14. An X-ray imaging system comprising:

an X-ray source configured to emit X-rays, the X-ray source comprising:

a field emitter array having a plurality of field emitter elements disposed in a vacuum chamber and configured to emit electrons in the vacuum chamber towards an anode assembly;

an anode disposed in the vacuum chamber for receiving the electrons emitted by the field emitter array and configured to thereby generate X-ray radiation; and a source of cleaning gas coupled to the vacuum chamber, wherein the source of cleaning gas is configured to provide the cleaning gas to the vacuum chamber towards the field emitter array to reduce deposition of contaminants on or to clean contaminates from the field emitter array; and a vacuum pump configured to create a vacuum inside the vacuum chamber following introduction of the cleaning gas to evacuate the vacuum charger; and an X-ray detector configured to receive the X-rays and generate signals capable of processing to form an image of a subject of interest.

15. The system of claim 14, wherein the X-ray source is stationary with respect to a frame of the system.

16. The system of claim 14, wherein the X-ray detector is stationary with respect to a frame of the system.

17. The system of claim 14, further comprising an X-ray controller configured to operate the field emitter array, wherein the field emitter array includes a plurality of independently controllable field emitter arrays, and the X-ray controller regulates production of X-rays from the field emitter arrays in accordance with a desired imagine protocol.

18. The system of claim 14, wherein the cleaning gas comprises hydrogen.

19. The system of claim 14, wherein the cleaning gas is introduced to the vacuum chamber when there is no emission of electrons by the field emitter array.

20. The system of claim 14, wherein the system is a computerized tomography (CT) system or a tomosynthesis system.

* * * * *